US008326181B2

(12) United States Patent
Nakagawa

(10) Patent No.: US 8,326,181 B2
(45) Date of Patent: Dec. 4, 2012

(54) IMAGE FORMING APPARATUS HAVING DRIVING ROLLER FOR AUTOMATIC STEERING OF INTERMEDIATE IMAGE TRANSFER BELT

(75) Inventor: Tomohito Nakagawa, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 235 days.

(21) Appl. No.: 12/723,067

(22) Filed: Mar. 12, 2010

(65) Prior Publication Data

US 2010/0239330 A1 Sep. 23, 2010

(30) Foreign Application Priority Data

Mar. 19, 2009 (JP) ..... 2009-067855

(51) Int. Cl.
*G03G 15/16* (2006.01)

(52) U.S. Cl. ..... 399/121

(58) Field of Classification Search ..... 399/121, 399/302, 308

See application file for complete search history.

(56) References Cited

FOREIGN PATENT DOCUMENTS

| | | | |
|---|---|---|---|
| JP | 11327314 A | * | 11/1999 |
| JP | 2001075449 A | * | 3/2001 |
| JP | 2001-147601 | | 5/2001 |
| JP | 2002-2999 | | 1/2002 |

OTHER PUBLICATIONS

Computer translation of detailed description and the drawing description for JP11-327314A, Nov. 1999; Takeuchi et al.*

* cited by examiner

*Primary Examiner* — Quana M Grainger
(74) *Attorney, Agent, or Firm* — Canon USA Inc IP Division

(57) ABSTRACT

An image forming apparatus includes an image bearing member, a belt member, a stretching roller, a driving roller configured to transmit a driving force to the belt member, a motor configured to supply a driving force to the driving roller, a first frame configured to rotatably support two ends of the stretching roller, a second frame disposed to be tiltable relative to the first frame and configured to rotatably support two ends of the driving roller, a steering driving unit configured to cause the second frame to perform a tilt operation, a tension roller disposed at a position adjacent the driving roller in the downstream side of the driving roller in the rotational direction of the belt member and configured to supply a tension to the belt member, and an elastic unit configured to elastically support the tension roller.

10 Claims, 9 Drawing Sheets

IMAGE FORMING APPARATUS HAVING DRIVING ROLLER FOR AUTOMATIC STEERING OF INTERMEDIATE IMAGE TRANSFER BELT

BACKGROUND OF THE INVENTION

1. Field of the Invention

The present invention relates to an image forming apparatus that transfers a toner image formed on an image bearing member to a recording material by using a belt member, and more particularly, to a driving roller that functions also as a steering mechanism for the belt member.

2. Description of the Related Art

An image forming apparatus that transfers a toner image formed on an image bearing member to a recording material by using a belt member (intermediate transfer belt) suspended on a plurality of stretching rollers has been widely used.

In addition, steering control for dynamically positioning the belt member in the longitudinal direction of a supporting rotating member by allowing the supporting rotating member to perform a tilt operation to move the belt member along the supporting rotating member has been put into practical use.

Japanese Patent Application Laid-Open Nos. 2001-147601 and 2002-2999 discuss a full color image forming apparatus in which a toner image, which is primarily transferred from a plurality of image bearing members to a downward-facing surface of a belt member, is transferred to a recording material in a secondary transfer portion that is set as a inverted portion of the belt member in the rotational direction thereof. In this apparatus, a driving roller that functions also as a steering roller for the belt member is disposed at the opposite side of a secondary transfer stretching roller, which suspends the belt member, in the secondary transfer portion with the plurality of image bearing members interposed therebetween.

To increase a driving force for the belt member and reduce the irregularity of rotation, the driving roller can have a large diameter and a large winding angle for the belt member. In addition, to reduce a property of separation of the recording material from the secondary transfer portion, the secondary transfer stretching roller has a tendency to have a small diameter.

Therefore, it is difficult to provide a function as a driving roller to the secondary transfer stretching roller. For this reason, there is proposed a configuration for increasing the diameter of the driving roller that functions also as a steering roller by employing the configuration discussed in Japanese Patent Application Laid-Open No. 2002-2999.

When the driving roller is tilted, the winding amount for the belt member at the one end portion of the driving roller becomes different from the winding amount for the belt member at the other end portion thereof. Therefore, at the end portions of the driving roller, an irregularity of transmission of the driving force from the driving roller to the belt member is increased, so that a stability of the rotation of the belt member deteriorates.

SUMMARY OF THE INVENTION

The present invention is directed to a driving roller having a steering function capable of reducing an irregularity of transmission of a driving force at two end portions of the driving roller.

According to an aspect of the present invention, an image forming apparatus includes an image bearing member, a rotatable belt member configured to carry a toner image transferred from the image bearing member, a stretching roller configured to suspend the belt member and to form a transfer portion at which the toner image formed on the belt member is transferred to a recording material, a driving roller disposed at an upstream side of the image bearing member in a downstream side of the transfer portion in a rotational direction of the belt member and configured to transmit a driving force to the belt member, a motor configured to supply a driving force to the driving roller, a first frame configured to rotatably support two ends of the stretching roller, a second frame disposed to be tiltable relative to the first frame and configured to rotatably support two ends of the driving roller, a steering driving unit configured to cause the second frame to perform a tilt operation, a tension roller disposed at a position adjacent the driving roller in the downstream side of the driving roller in the rotational direction of the belt member and configured to supply a tension to the belt member, and an elastic unit configured to elastically support the tension roller.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

In the present invention, if a motor is disposed to a frame that supports a driving roller, the present invention can be embodied by another exemplary embodiment where a configuration of an exemplary embodiment can be partially or entirely replaced with an alternative configuration.

The present invention is not limited to a tandem type full color image forming apparatus, but may be embodied in a single-drum type full color image forming apparatus or a monochromatic image forming apparatus.

In an exemplary embodiment of the present invention, only main components associated with formation and transfer of a toner image are described. However, the present invention may be adapted to various uses such as printers, printing machines, copying machines, facsimile machines, and multifunctional peripherals, if necessary components, devices, and a casing are added thereto.

General features of the image forming apparatus discussed in Japanese Patent Application Laid-Open No. 2002-2999 will not be described with reference to drawings, and description thereof will be omitted.

Figure 1:
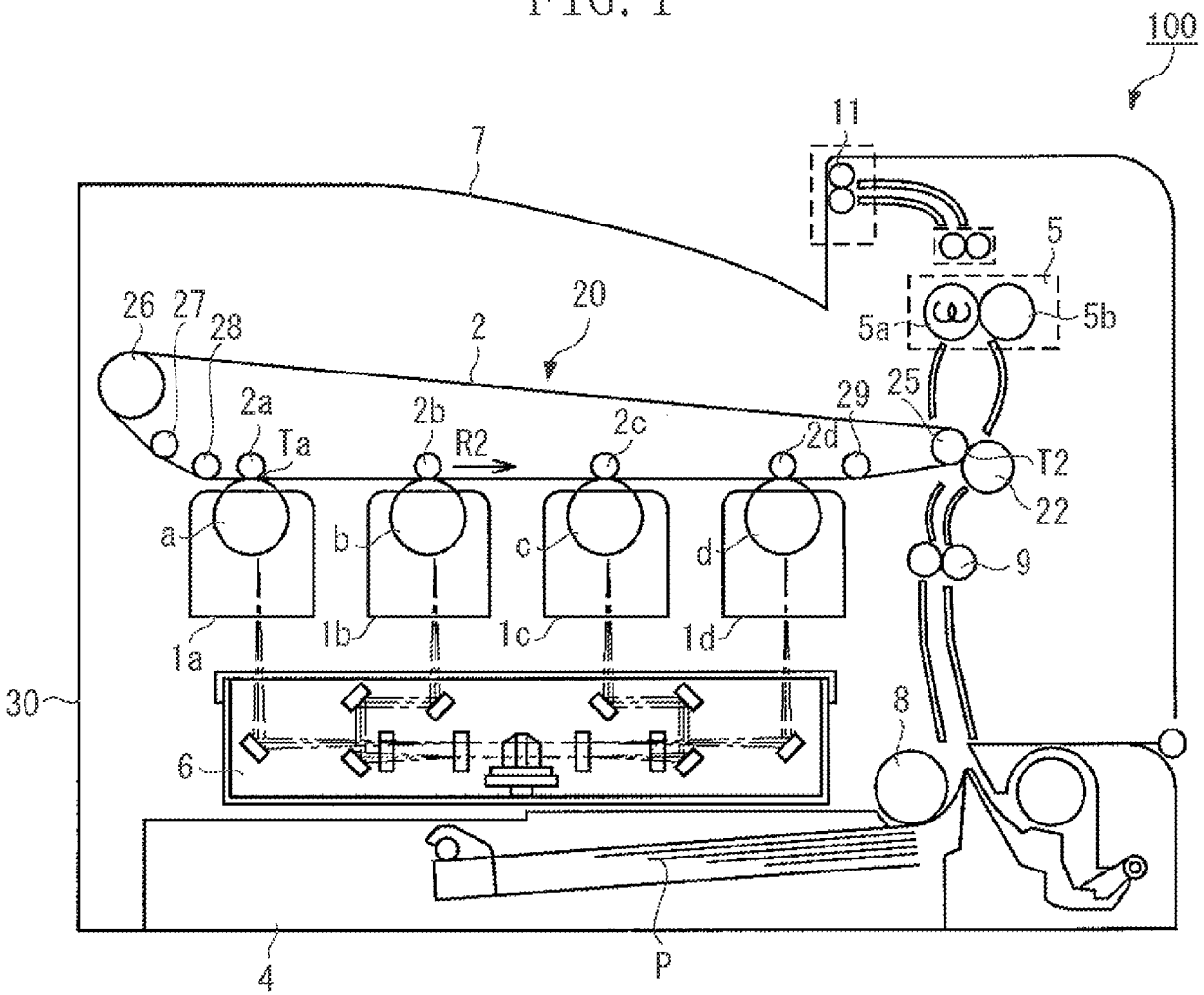
FIG. 1 is a view illustrating a configuration of an image forming apparatus according a first exemplary embodiment of the present invention.

FIG. 1 is a view illustrating a configuration of an image forming apparatus according a first exemplary embodiment of the present invention.

As illustrated in FIG. 1, an image forming apparatus 100 is a tandem type intermediate transfer scheme full color printer, in which image forming units 1*a*, 1*b*, 1*c*, and 1*d* are arranged along a downward-facing surface of an intermediate transfer belt 2.

In the image forming unit 1*a*, a yellow toner image is formed on a photosensitive drum a, and the toner image is primarily transferred to the intermediate transfer belt 2. In the image forming unit 1*b*, a magenta toner image is formed on a photosensitive drum b, and the toner image is primarily transferred to the yellow toner image on the intermediate transfer belt 2 in the overlapped manner. In the image forming units 1*c* and 1*d*, the cyan and black toner images are formed on photosensitive drums c and d, and the toner images are sequentially primarily transferred to the intermediate transfer belt 2 in the overlapped manner.

The four-color toner image primarily transferred to the intermediate transfer belt 2 is transported to a secondary transfer portion T2 to be secondarily transferred to a recording material P at one time. The recording material P, to which the four-color toner image is secondarily transferred, is heated and pressed by a fixing device 5, so that the toner image is fixed on the surface of the recording material P. After that, the recording material P is discharged through a discharging roller 11 to an upper tray 7.

A separation roller 8 separates the recording material P extracted from a recording material cassette 4 sheet by sheet and transmits the recording material P to a registration roller 9. The registration roller 9 receives the recording material P in a stopped state and allows the recording material P to stand by. The registration roller 9 transmits the recording material P to the secondary transfer portion T2 in synchronization with the timing of the toner image on the intermediate transfer belt 2.

In the fixing device 5, a heating nip is formed by pressing a pressing roller 5*b* to a fixing roller 5*a* provided with a heater. During the process where the recording material P is transported to the heating nip to be heated and pressed, the toner image is dissolved, so that the full color image is fixed on the surface of the recording material P.

The image forming units 1*a*, 1*b*, 1*c*, and 1*d* have the substantially same configuration except that toners used in the corresponding developing units have different colors such as yellow, magenta, cyan, and black. Hereinafter, only the image forming unit 1*a* is described, and "a" attached to reference numerals of components thereof is replaced with "b", "c", and "d" for the description of the other image forming units 1*b*, 1*c*, and 1*d*.

The image forming unit 1*a* is configured as a replacement unit (process cartridge) including a photosensitive drum a.

The photosensitive drum a has a photosensitive layer, of which a charge polarity is negative, formed on an outer circumferential surface of an aluminum cylinder. The photosensitive drum a is rotated at a predetermined process speed by a driving force transmitted from a driving motor (not illustrated).

The photosensitive drum a is uniformly charged with a negative voltage by using a charging roller (not illustrated) built in the image forming unit 1*a*.

An exposure device 6 writes an electrostatic image on the surface of the charged photosensitive drum a by scanning a laser beam, which is obtained by ON-OFF modulating scan line image data rasterized from a decomposed yellow color image, through a rotating mirror. The electrostatic image written on the photosensitive drum a is attached with toner through a developing device (not illustrated) built in the image forming unit 1*a*, so that the toner image is inversely developed.

A primary transfer roller 2*a* presses the intermediate transfer belt 2, so that a primary transfer portion Ta is formed between the photosensitive drum a and the intermediate transfer belt 2. The primary transfer roller 2*a* is applied with a positive DC voltage, so that the toner image carried by the photosensitive drum a is primarily transferred to the intermediate transfer belt 2, which passes through the primary transfer portion Ta.

An intermediate transfer unit 20 is disposed over the image forming units 1*a*, 1*b*, 1*c*, and 1*d*. The intermediate transfer unit 20 is a replacement unit that can be replaced by integral detachment and attachment without detachment and attachment associated with rotational driving from the image forming apparatus 100. The intermediate transfer unit 20 includes a supporting mechanism and a driving mechanism for the intermediate transfer belt 2.

As an example of a belt member, the intermediate transfer belt 2 is suspended and supported by a tension roller 27, a driving roller 26, a secondary transfer stretching roller 25, and primary transfer stretching rollers 28 and 29. The intermediate transfer belt 2 is driven by the driving roller 26 to rotate in the direction of arrow R2. The intermediate transfer belt 2 is an endless belt member and is made of a substantially non-extensible material such as polyimide. The intermediate transfer belt 2 is suspended by the driving roller 26 and the secondary transfer stretching roller 25 to invert the rotational direction.

In the intermediate transfer unit 20, the primary transfer rollers 2*a*, 2*b*, 2*c*, and 2*d* are provided corresponding to the image forming units 1*a*, 1*b*, 1*c*, and 1*d*. The primary transfer rollers 2*a*, 2*b*, 2*c*, and 2*d* are urged to the photosensitive drums a, b, c, and d by springs to cause the intermediate transfer belt 2 to contact the photosensitive drums a, b, c, and d, so that a primary transfer portion for the toner image is formed.

The secondary transfer portion T2 is formed by causing a secondary transfer roller 22 to contact the intermediate transfer belt 2, of which an inner surface is suspended by the secondary transfer stretching roller 25. The secondary transfer stretching roller 25 is mounted in the intermediate transfer unit 20, while the secondary transfer roller 22 is mounted in a main body 30 of the image forming apparatus 100. The secondary transfer stretching roller 25 suspends the intermediate transfer belt 2 at the secondary transfer portion T2 for the toner image. The secondary transfer roller 22 is applied with a positive DC voltage from a power source (not illustrated), so that a transferring electric field for the toner image is formed between the secondary transfer roller 22 and the secondary transfer stretching roller 25, which is connected to the ground voltage.

In addition, in the present exemplary embodiment, a configuration in which the entire second frame that supports the driving roller 26 is allowed to perform a tilt operation relative to the second frame is employed.

Figure 2:
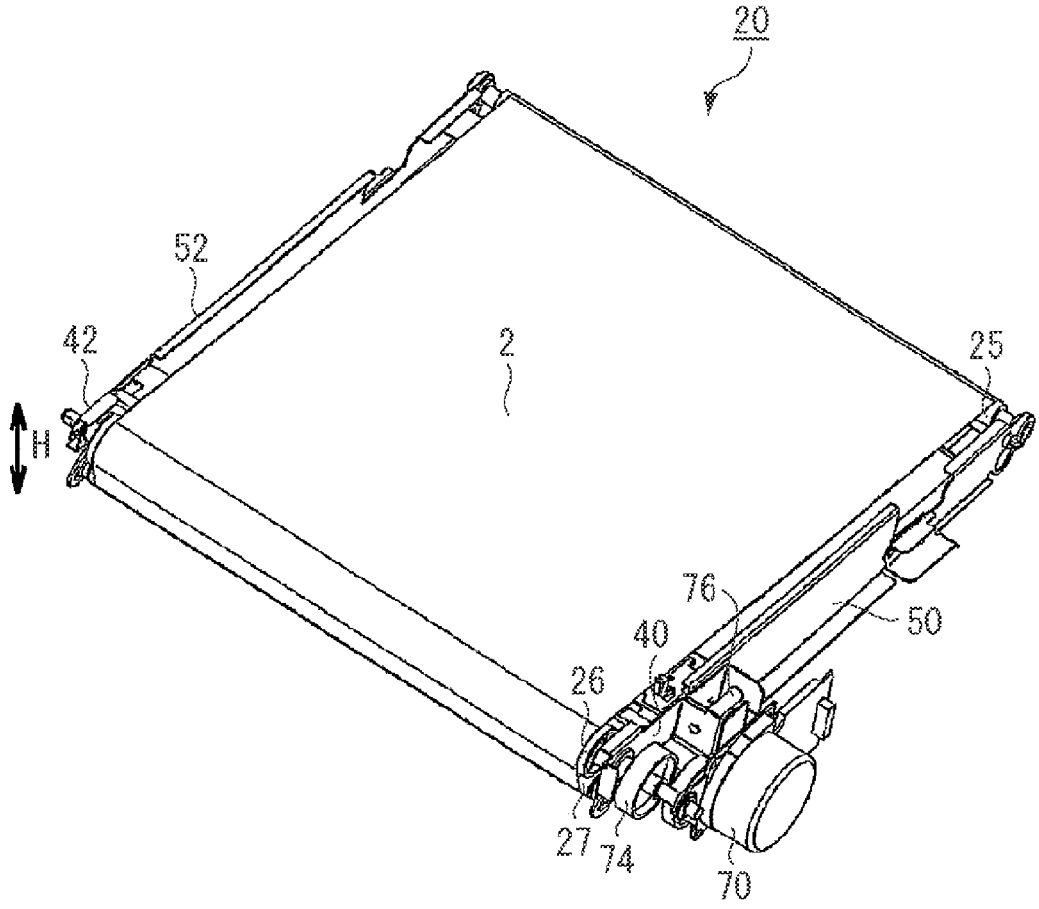
FIG. 2 is a perspective view illustrating an intermediate transfer unit.
Figure 3:
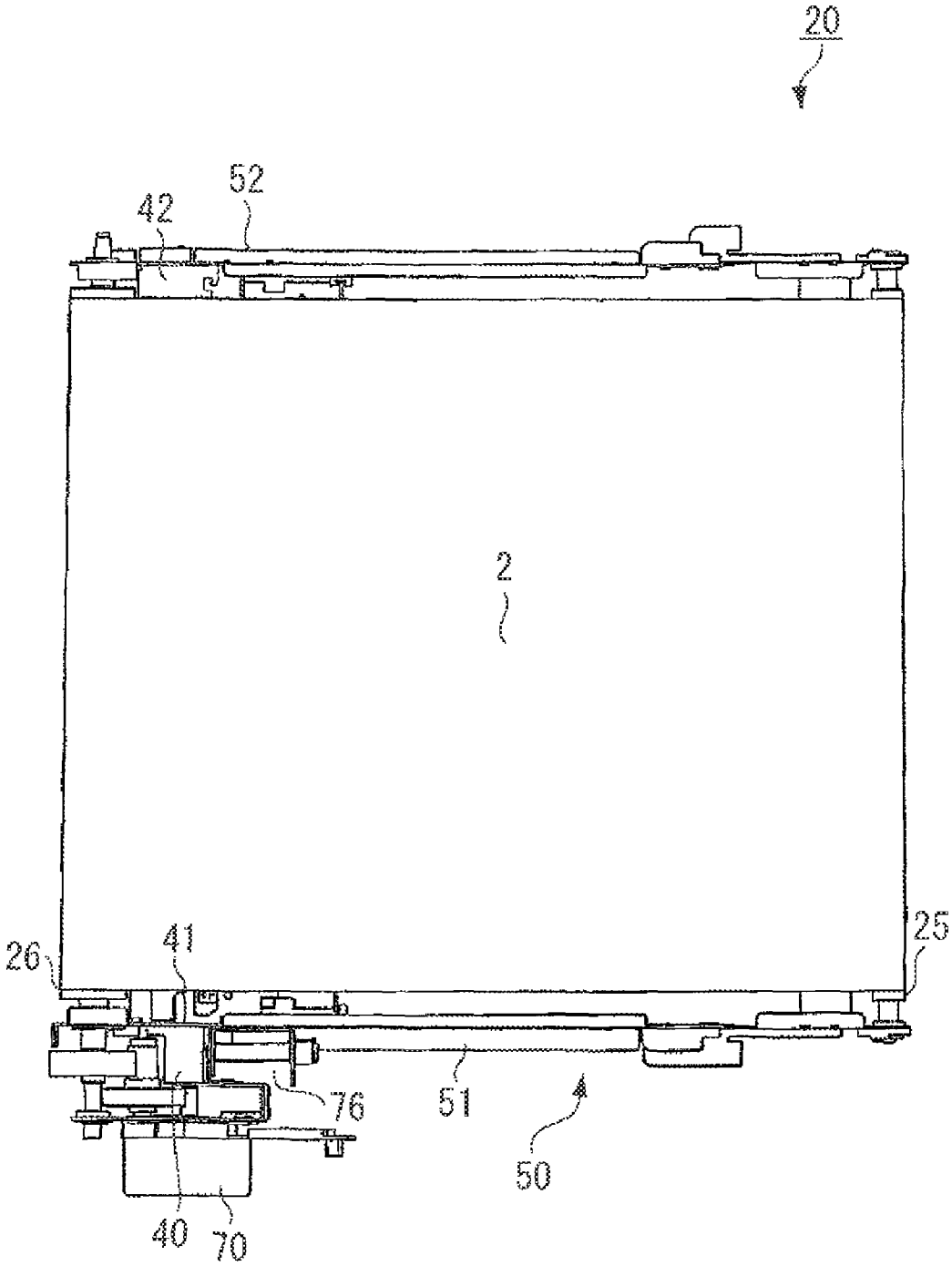
FIG. 3 is a plan view illustrating the intermediate transfer unit.
Figure 4A:
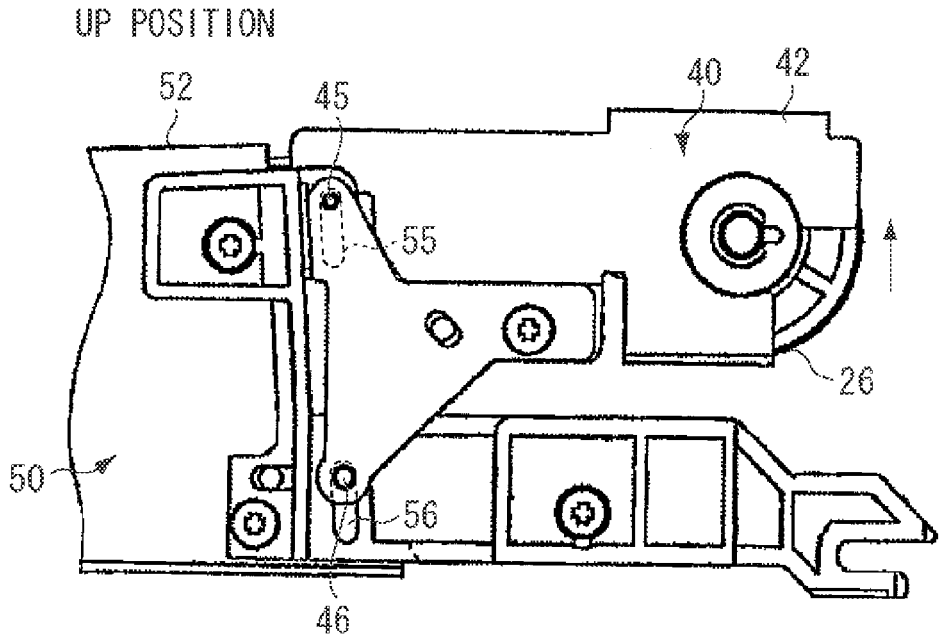
FIGS. 4A and 4B are views illustrating up and down states at the other end side of a second frame.
Figure 4B:
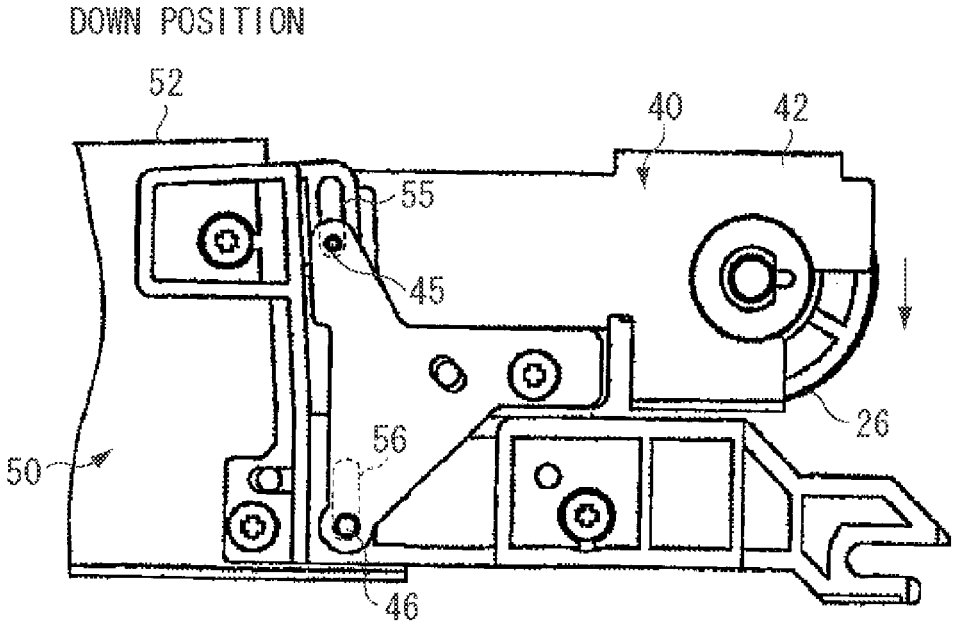
Figure 5:
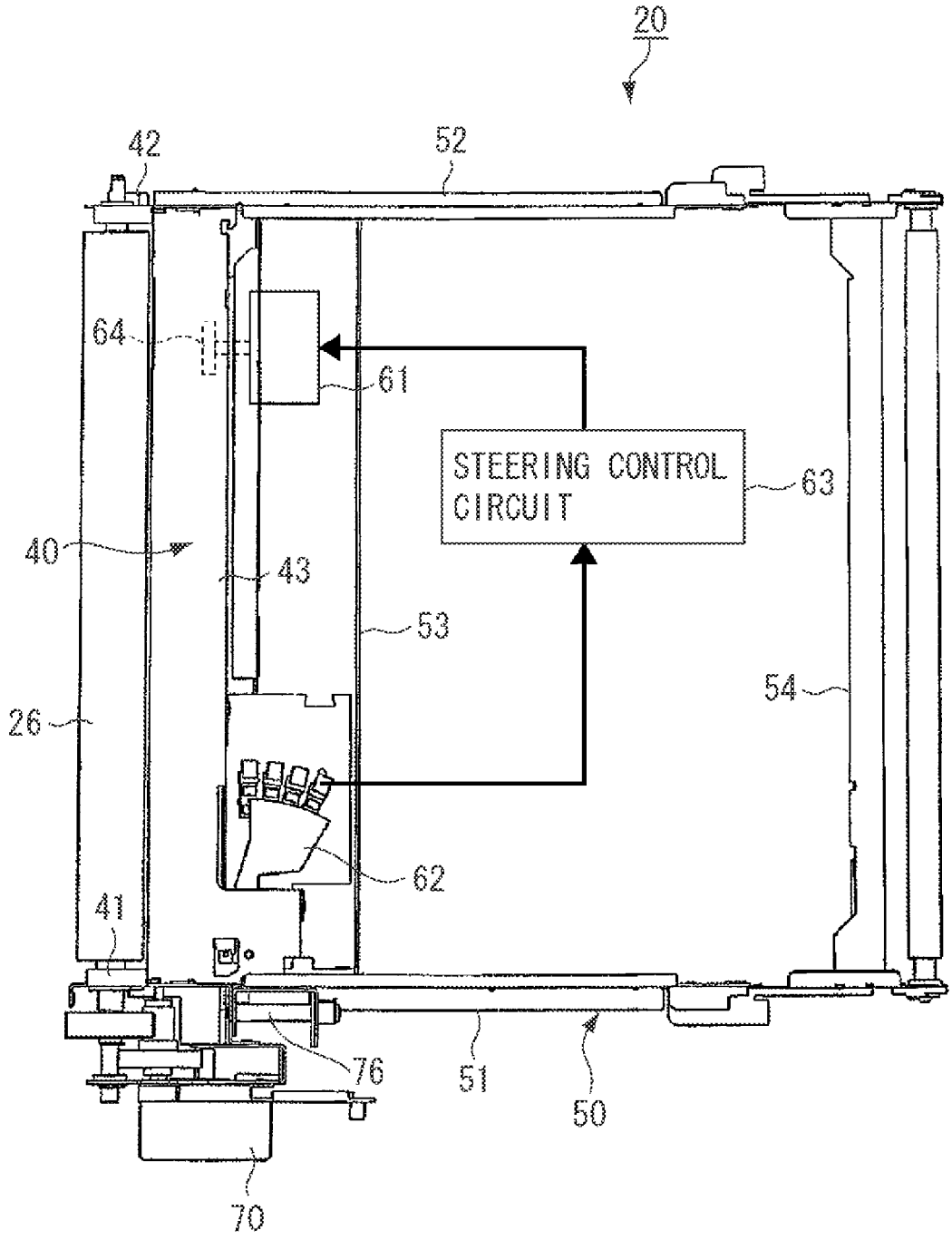
FIG. 5 is a view illustrating a planar layout of a first frame and a second frame.
Figure 6:
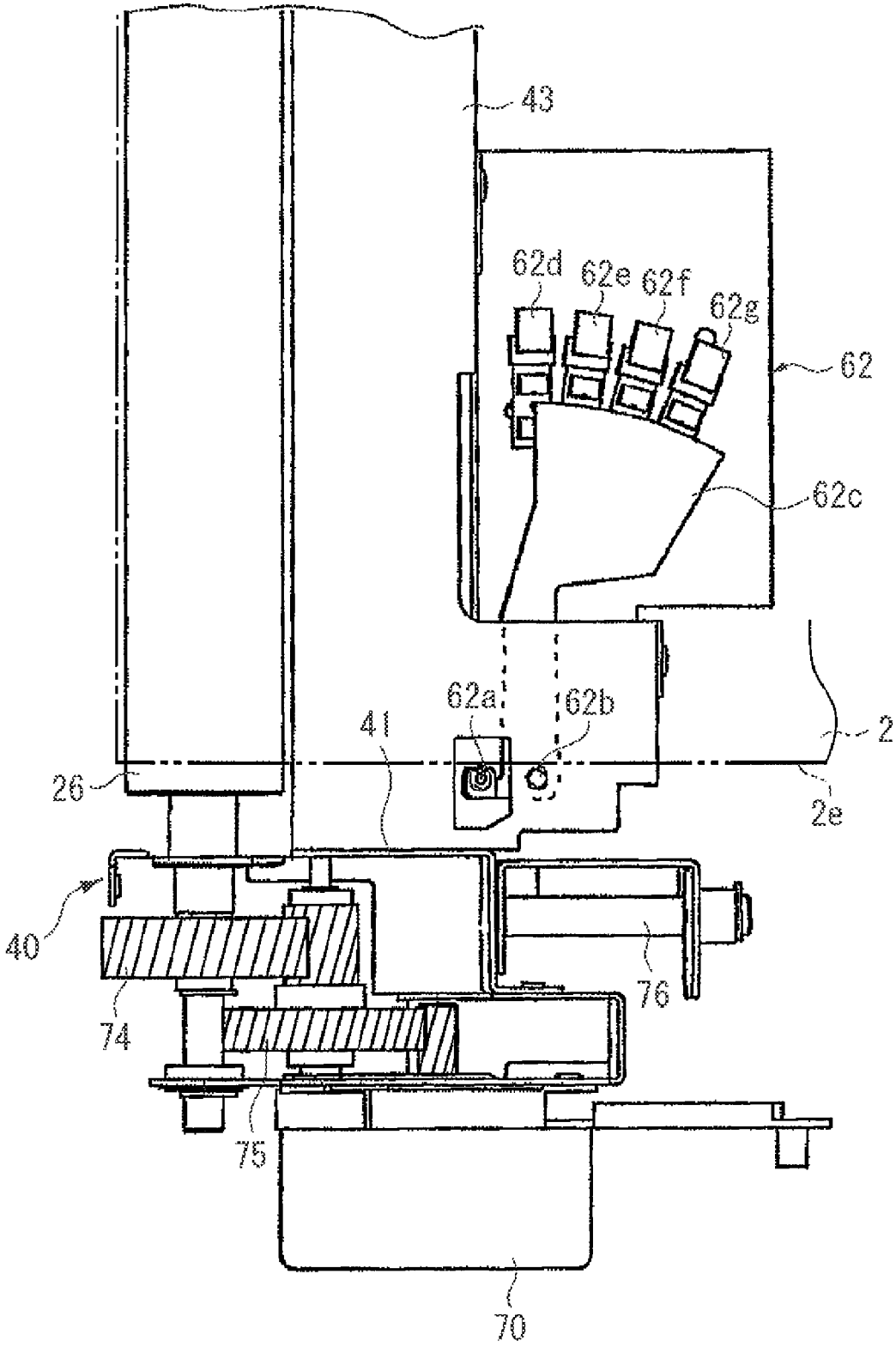
FIG. 6 is a view illustrating a driving mechanism for a driving roller.

FIG. 2 is a perspective view illustrating the intermediate transfer unit 20, and FIG. 3 is a plan view illustrating the intermediate transfer unit 20. FIGS. 4A and 4B are views illustrating up and down states at the other end side of the second frame. FIG. 5 is a view illustrating a planar layout of the first frame and the second frame. FIG. 6 is a view illustrating a driving mechanism for the driving roller 26. In addition, in FIGS. 2 to 6, some of the stretching rollers illustrated in FIG. 1 are not illustrated.

As illustrated in FIG. 2, in the intermediate transfer unit 20, a motor 70 is fixed to the one end side of the second frame 40, which rotatably supports the two end portions of the driving roller 26. In addition, a driving force from the motor 70 is transmitted to the driving roller 26 in the second frame 40.

As illustrated in FIG. 3, the first frame 50 rotatably supports the two end portions of the secondary transfer stretching roller 25, and the two end portions thereof are connected to each other in a frame shape. The second frame 40 is configured to able to tilt relative to the first frame 50 and to rotatably support the two end portions of the driving roller 26, and the two end portions thereof are connected to each other in a frame shape.

In the second frame 40, a side plate 41 at the one end side thereof is pivotally supported to the first frame 50 by a rotating shaft 76. In addition, a side plate 42 at the other end side of the second frame 40 is movably supported along a side plate 52 at the other end side of the first frame 50.

As illustrated in FIG. 4A, up and down guide grooves 55 and 56 are provided to the side plate 52 at the other end side of the first frame 50, and guide pins 45 and 46 fixed to the second frame 40 are inserted into the guide grooves 55 and 56.

For this reason, as illustrated in FIG. 4B, the other end sides of the second frame 40 can be moved up and down within movable ranges of the guide pins 45 and 46 in the guide grooves 55 and 56.

FIG. 5 illustrates a state in which the intermediate transfer belt 2 is removed from the plan view of the intermediate transfer unit 20 illustrated in FIG. 3.

As illustrated in FIG. 5, the side plate 51 and the side plate 52 of the first frame 50 are connected to each other at the two end sides of the beam plates 53 and 54. The side plate 41 and the side plate 42 of the second frame 40 are connected to each other at the two end sides of the beam plate 43. In order to perform a tilt operation of the driving roller 26 together with the motor 70, the second frame 40, which supports the above components, is configured as a frame in a frame shape that ensures such strength as needed. In addition, the first frame 50 includes a steering motor 61, and the second frame 40 includes the motor 70. Thus, the intermediate transfer unit 20 is configured as an integrally replaceable belt unit without mechanical detachment and attachment to a main body (30 in FIG. 1) of the image forming apparatus 100.

The steering motor 61 allows the second frame 40 to perform a tilt operation to steer the intermediate transfer belt 2 through the driving roller 26. The steering motor 61 is disposed on the beam plate 53 of the first frame 50 to move up and down the beam plate 43 of the second frame 40 via an eccentric cam 64. In this manner, a driving unit 61 that allows the second frame 40 to perform a tilt operation is disposed on the first frame 50, so that the driving roller 26 supported by the second frame 40 can be moved relative to the first frame 50, as a fixing reference, at a high accuracy.

A belt edge sensor 62 is fixedly disposed on the beam plate 43 of the second frame 40 to detect the position of the intermediate transfer belt 2 in the longitudinal direction of the driving roller 26 to steer the intermediate transfer belt 2.

A steering control circuit 63 operates the steering motor 61 according to an output of the belt edge sensor 62 to rotate the eccentric cam 64, so that the other end side (movable up and down) of the second frame 40 is moved up or down. The steering control circuit 63 steers the intermediate transfer belt 2 by allowing the driving roller 26 to perform a tilt operation according to the output of the belt edge sensor 62.

As illustrated in FIG. 6, the motor 70, which drives the driving roller 26 to rotate the intermediate transfer belt 2, is disposed at the one end side of the second frame 40 to transmit a driving force to the driving roller 26 at the one end side thereof. The rotation driving of the motor 70 is transmitted to the driving roller 26 via gears 75 and 74. The intermediate transfer belt 2 can be driven to rotate at a desired speed by the motor 70, which drives and rotates the driving roller 26, and the gears 74 and 75 connected to the motor 70.

An irregularity of driving involved with the tilt operation of the driving roller 26 can be avoided by disposing the motor 70 and the rotation transmission mechanisms (74 and 75 in FIG. 6) on the second frame 40, which performs the tilt operation integrally together with the driving roller 26. This is because there is not a change in the state of contacting with the motor-side gears involved with the tilt operation of the driving roller similar to a mechanism discussed in Japanese Patent Application Laid-Open No. 2002-2999. In addition, this is because there is no need to use gears in the case of the tilt operation of engaged surfaces similar to the mechanism discussed in Japanese Patent Application Laid-Open No. 2002-2999, and this is also because the rotation transmission can be performed at high accuracy with simple mechanism parts. In addition, since the motor 70 and the gears 74 and 75 are simultaneously moved in association with the tilt operation of the driving roller 26, there is no fluctuation in the rotation speed due to the irregularity of transmission of driving the engagement of the gears 74 and 75.

The motor 70 is disposed at the opposite side of the driving roller 26 with respect to the rotating shaft 76 to decrease the moment of inertia of the supporting shaft (rotating shaft 76) of the second frame 40 including the driving roller 26 and the motor 70.

In other words, the center of the tilt operation of the steering by the driving roller 26 is the rotating shaft 76, and by taking into consideration balance at the time of the tilt operation of the driving roller 26, the motor 70 having a relatively high weight is set to the center side of the tilt operation. For this reason, although the driving roller 26 is frequently inverted and moved at a high speed, the impact and vibration transmitted to the first frame 50 can be decreased, and the irregularity of the speed of the intermediate transfer belt 2 due to the impact and vibration occurring in the first frame 40 can be decreased. Since the moment of inertia of the second frame 40 including the driving roller 26 and the motor 70 to the rotation about the rotating shaft 76 is small, a smooth steering operation can be obtained.

As an example of a belt position detecting sensor, the belt edge sensor 62 is a reflecting light detection type semiconductor sensor, which detects a meandering amount of the intermediate transfer belt 2 in real time. In the belt edge sensor 62, a sensing roller 62*a* fixed to the one end of a sensor flag 62*c*, which is pivotally supported by a rotating shaft 62*b*, is configured to be in contact with a belt edge of the intermediate transfer belt 2. Four reflecting light detecting sensors 62*d*, 62*e*, 62*f*, and 62*g* are disposed along the sensor flag 62*c* to detect one reflecting surface fixed to the sensor flag 62*c*, which is rotated at the opposite side of the sensing roller 62*a*, at different rotation positions.

The belt edge sensor 62 is fixed to the second frame 40 and is disposed at the tight side of the intermediate transfer belt 2 in the vicinity of the driving roller 26. When the intermediate transfer belt 2 is driven, since the positions on the tight side thereof are stabilized without the flutter of the edge of the intermediate transfer belt 2, an error of the edge detection can be reduced. Since the vicinity of the driving roller 26 is without the flutter of the edge of the intermediate transfer belt 2, the error of the edge detection can be reduced.

Particularly, since the belt edge sensor 62 is fixed to the second frame 40, although the edge of the belt edge sensor 62 is moved up or down due to the tilt operation of the driving roller 26, the belt edge sensor 62 and the edge of the intermediate transfer belt 2 are not moved relative to each other. Therefore, as an example of a belt position detecting sensor, the belt edge sensor 62 prevents the error involved with a bending of the edge involved with the up and down movement of the edge of the intermediate transfer belt 2 to accurately detect the position of the intermediate transfer belt 2.

Figure 7:
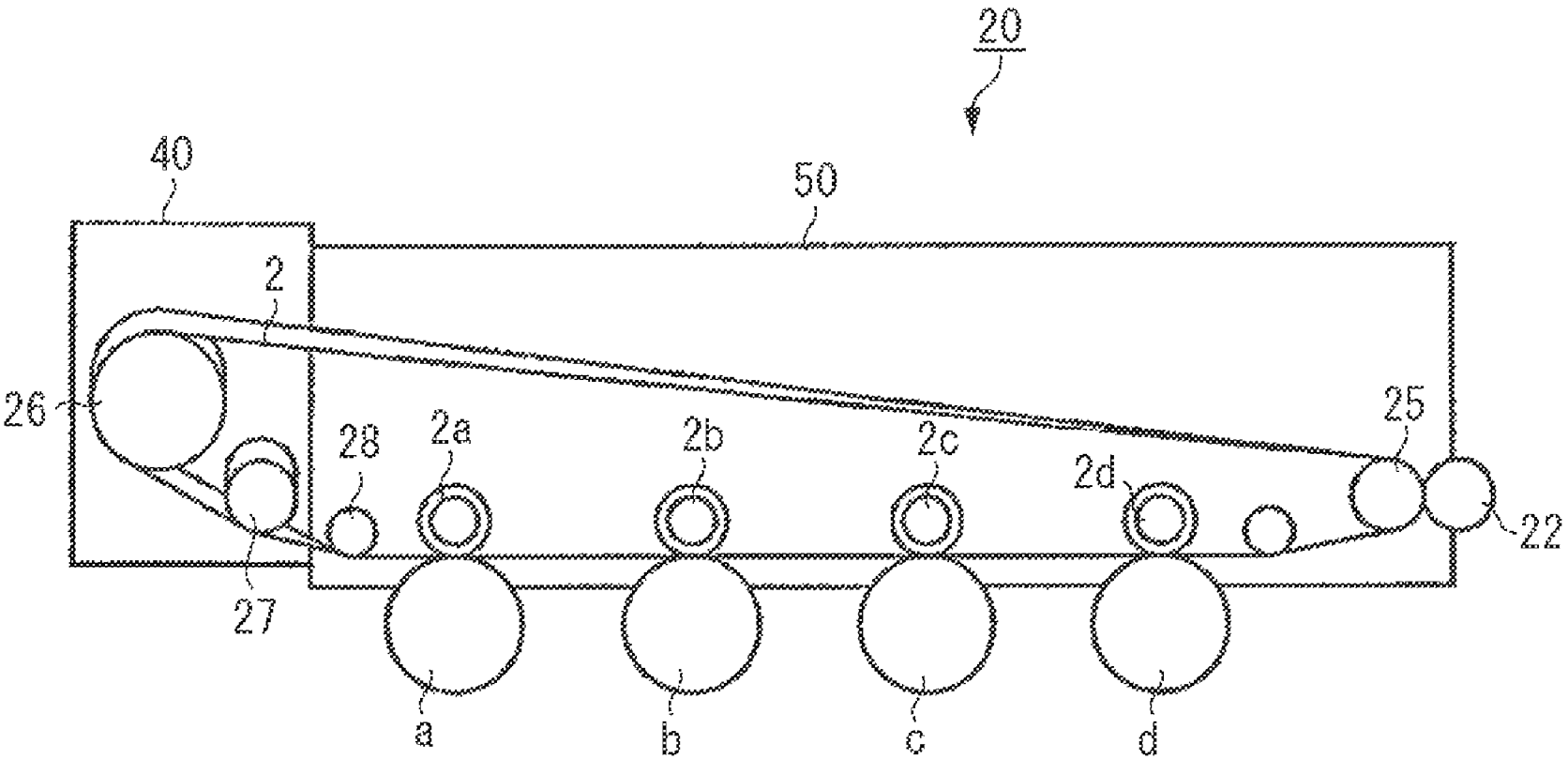
FIG. 7 is a diagrammatic view illustrating a layout of rollers of an intermediate transfer unit.
Figure 8:
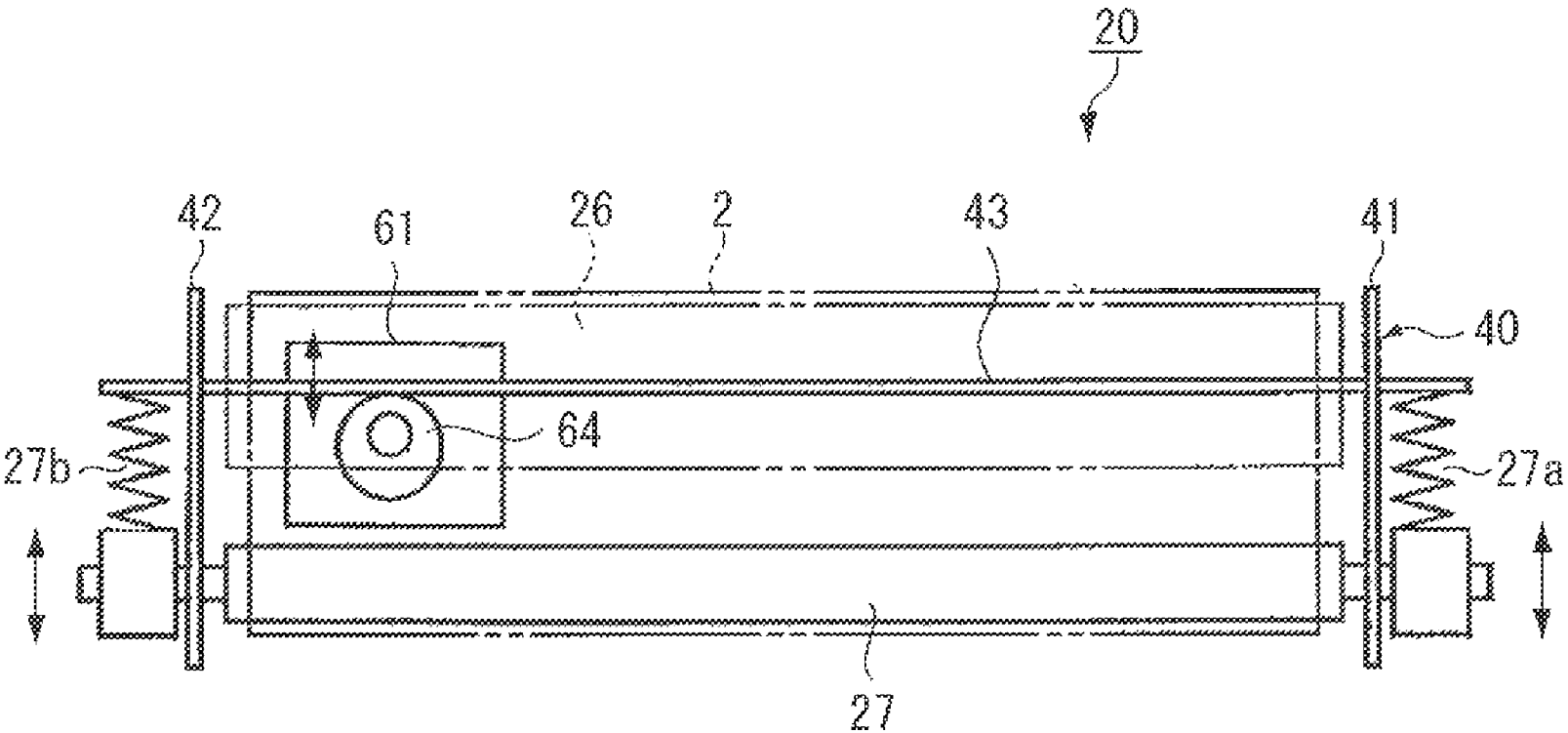
FIG. 8 is a view illustrating a supporting mechanism for a tension roller.

FIG. 7 is a diagrammatic view illustrating a layout of rollers of the intermediate transfer unit. FIG. 8 is a view illustrating a supporting mechanism for the tension roller.

As illustrated in FIG. 7, in the first exemplary embodiment, the primary transfer stretching roller 28 is disposed just before the primary transfer roller 2*a* to prevent propagation of a tilt of a rotating surface of the intermediate transfer belt 2 in involvement with the tilt operation of the driving roller 26. In addition, the tension roller 27 is disposed at a loose side of the intermediate transfer belt 2, which is formed at the downstream side of the driving roller 26, to ensure a tension state required for the primary transfer surface of the intermediate transfer belt 2.

In other words, the primary transfer stretching roller 28 is disposed between the tension roller 27 and the primary transfer roller 2*a*, so that the intermediate transfer belt 2 is allowed to be in the horizontal line directing from the primary transfer stretching roller 28 to the primary transfer roller 2*a*. Therefore, when the tension roller 27 is tilted by the tilt operation of the driving roller 26 involved with the steering operation, the influence of the primary transfer stretching roller 28 on the primary transfer surface can be avoided.

The tension roller 27 disposed between the primary transfer stretching roller 28 and the driving roller 26 prevents a change in tension of the intermediate transfer belt 2 involved with the tilt operation of the driving roller 26 and a propagation of vibration that propagates through the intermediate transfer belt 2. In the steering operation of the intermediate transfer belt 2 using the driving roller 26, the vibration is absorbed by the tension roller 27, and the primary transfer surface is straightened by the primary transfer stretching roller 28. Therefore, a positional deviation of an image on the primary transfer surface of the intermediate transfer belt 2 and the influence of vibration can be reduced.

The secondary transfer stretching roller 25, primary transfer rollers 2*a*, 2*b*, 2*c*, and 2*d*, and primary transfer stretching rollers 28 and 29 are disposed in the first frame 50.

The primary transfer stretching roller 28 suspends the intermediate transfer belt 2 between the driving roller 26 and the photosensitive drum a to define the primary transfer surface for the toner image. The primary transfer stretching roller 29 suspends the intermediate transfer belt 2 between the secondary transfer stretching roller 25 and the photosensitive drum d to define the primary transfer surface for the toner image. The primary transfer stretching roller 28 prevents the movement of the rotating surface of the intermediate transfer belt 2 due to the tilt operation of the driving roller 26 to ensure a planarity of the primary transfer surface.

The primary transfer rollers 2*a*, 2*b*, 2*c*, and 2*d* are disposed to be capable of moving up and down relative to the first frame 50. The primary transfer rollers 2*a*, 2*b*, 2*c*, and 2*d* are urged by springs to press the photosensitive drums a, b, c, and d by a predetermined pressure. Therefore, the planarized surface of the intermediate transfer belt 2, which is suspended by the primary transfer stretching rollers 28 and 29, of which the shaft ends are positioned to the first frame 50, is allowed to be in contact with the photosensitive drums a, b, c, and d.

On the other hand, the driving roller 26 and the tension roller 27 are disposed on the second frame 40. The driving roller 26 is disposed at the opposite side of the secondary transfer stretching roller 25 with the photosensitive drums a, b, c, and d interposed therebetween to drive and rotate the intermediate transfer belt 2.

The intervals of the photosensitive drums a, b, c, and d are set to be the same as a circumferential length of the secondary transfer stretching roller 25 (or an integer multiple thereof). This is because the influence on the image transferred to the recording material is minimized by equalizing a period of an irregularity of transfer caused by an eccentric error of the secondary transfer stretching roller 25 and a period of an error of overlap alignment of the toner image on the photosensitive drums a, b, c, and d. In addition, the secondary transfer stretching roller 25 is configured to have a diameter smaller than that of a conventional roller to separate thin sheets using a curvature thereof. Since the diameter is defined according to the intervals between the photosensitive drums a, b, c, and d, the diameter is unnecessarily decreased.

Therefore, the diameter of the driving roller 26 is much larger than that of the secondary transfer stretching roller 25. If the diameter of the driving roller 26 is large, the winding length of the intermediate transfer belt 2 is increased, so that the slipping can be reduced. However, if the slipping is reduced, the irregularity of driving of the driving roller 6 and the tilt operation thereof involved with the steering thereof may easily influence the rotation speed of the intermediate transfer belt 2.

In other words, the driving roller 26 is configured so that the winding angle is ensured to be at least 90 degrees or more to drive the intermediate transfer belt 2. Therefore, the gripping force of the intermediate transfer belt 2 is increased, so that the slipping can be prevented. Any slight slipping causes a defect of image. Since the gripping force is increased due to the large winding angle, the movement of the intermediate transfer belt 2 in the axial direction according to the tilt angle of the driving roller 26 is not easily prevented by the slipping, and the control of meandering can be performed with a fast response.

However, if the driving roller 26 having small slipping is tilted, a change in the tension at the longitudinal portion of the intermediate transfer belt 2 suspended by the primary transfer stretching rollers 28 and 29 can be easily propagated. Therefore, the tension roller 27 is disposed between the primary transfer stretching roller 28 and the driving roller 26, so that a change in tension involved with the tilt operation of the driving roller 26 is prevented by the tension roller 27.

The tension roller 27 exerts a tension onto the intermediate transfer belt 2 by pressing the intermediate transfer belt 2 outwards between the primary transfer stretching roller 28 and the driving roller 26. The intermediate transfer belt 2 is exerted with a tension of 30 N (3 kgf) by the tension roller 27.

As illustrated in FIG. 8, the tension roller 27 is configured so that the two ends thereof are individually supported through tension springs 27*a* and 27*b* as an example of an elastic member by the second frame 40. The forces of the tension springs 27*a* and 27*b* are received by the beam plate 43 of the second frame 40. When the driving roller 26 is tilted through the rotation of the eccentric cam 64, the bases of the tension springs 27*a* and 27*b* supporting the two ends of the tension roller 27 are tilted integrally with the beam plate 43 of the second frame 40. Therefore, although the driving roller 26 is tilted in association with the steering of the intermediate transfer belt 2, the deformation amounts of the tension springs 27*a* and 27*b* are not changed, so that the tension distribution of the intermediate transfer belt 2 in the longitudinal direction of the tension roller 27 is uniformly maintained.

Since the intermediate transfer belt 2 is constructed with a material, of which the circumferential length is not substantially changed, if the other end side of the driving roller 26 is moved up, the tension roller 2 follows the motion of the driving roller 26, so that the other end side of the tension roller 27 is moved up. Therefore, in comparison with the case where the tension roller 27 is disposed on the first frame 50, in this arrangement, the influence of the intermediate transfer belt 2 on the primary transfer surface in the circumferential direction and the axial direction is small.

In other words, if there occurs a difference (unbalance) in tension of the intermediate transfer belt 2 between the front side and the rear side thereof in the axial direction, the one side of the intermediate transfer belt 2 is slipped, which leads to the meandering. However, according to the configuration of the first exemplary embodiment, since the tension springs 27*a* and 27*b* supported by the second frame 40 are simultaneously moved up and down, the tension between the front side and the rear side is not changed, so that the steering control can be stably performed.

In addition, since a portion of the weight of the second frame 40 exerted in the gravity direction is received by the tension exerted to the second frame 40 in a double-supporting manner, the deformation or vibration of the second frame 40 caused by the weight thereof is reduced. In addition, since the driving roller 26 is moved integrally with the tension roller 27, the tension between the front side and the rear side in the axial direction is not changed similar to the case where the tension roller 27 is supported by the first frame. If the tension between the front side and the rear side in the axial direction is changed, the tension states of the front and rear sides of the intermediate transfer belt 2 are unbalanced, so that the meandering of the intermediate transfer belt 2 occurs due to the unbalance. As a result, a problem arises in that the steering control is not stabilized.

In addition, if the tension springs 27*a* and 27*b* supporting the tension roller 27 are received by the first frame 50, the second frame 40 may be bent due to the weight of the second frame 40 including the driving roller 26 and the motor 70. Therefore, the response of the steering operation of the intermediate transfer belt 2 to the tilt operation of the driving roller 26 deteriorates. Accordingly, a problem arises in that the strength of the second frame 40 and the cost and weight of parts are increased.

In the first exemplary embodiment, the driving roller 26 is disposed at a position as far as possible from the primary transfer rollers 2*a*, 2*b*, 2*c*, and 2*d* and the secondary transfer stretching roller 25 at the tight side of the intermediate transfer belt 2 at the driving time thereof. Therefore, the influence of the tilt operation of the driving roller 26 on the image, which is involved with the steering of the intermediate transfer belt 2, can be reduced.

In the first exemplary embodiment, the rotation thickness of the intermediate transfer belt 2 is reduced to a minimum thereof so that the height thereof is defined by the diameter of the driving roller 26 and the protrusion amount of the tension roller 27. Therefore, the height of the image forming apparatus (100 in FIG. 1) can be effectively reduced.

In the first exemplary embodiment, the load of the second frame 40 can be reduced by using the tension of the intermediate transfer belt 2, so that the steering control can be accurately performed by using a simple, light, and inexpensive configuration.

In the first exemplary embodiment, similar to the configuration discussed in Japanese Patent Application Laid-Open No. 2002-2999, even if the tilt operation portion performs a simple straight movement without an elliptic movement, a roller arrangement in which the influence on the transfer surface is small can be configured. In the case of the straight movement, an accuracy of parts can be easily ensured, and a simple, inexpensive configuration can be implemented. A highly-accurate driving control mechanism or a complex guiding mechanism is not needed, but a simple configuration may be employed.

In the first exemplary embodiment, since the primary transfer stretching roller 28 is disposed between the tension roller 27 and the photosensitive drum a, the tension roller 27 can be moved without the influence on the reference surface.

As described above, the tension roller is disposed nearest the driving roller at the loose side of the belt, so that the influence on the image in the circumferential direction and the axial direction of the transfer image surface at the tight side of the belt can be reduced. In addition, the width directional position of the belt can be moved by the driving roller, so that the belt width directional movement together with the belt driving directional movement can be accurately performed without slipping of the intermediate transfer belt and the driving roller. In addition, the tension of the tension roller is received by the second frame, so that the weight of the second frame is backed up. Therefore, the influence on the primary transfer surface can be reduced by using a simple configuration capable of performing a smooth tilt operation.

Figure 9:
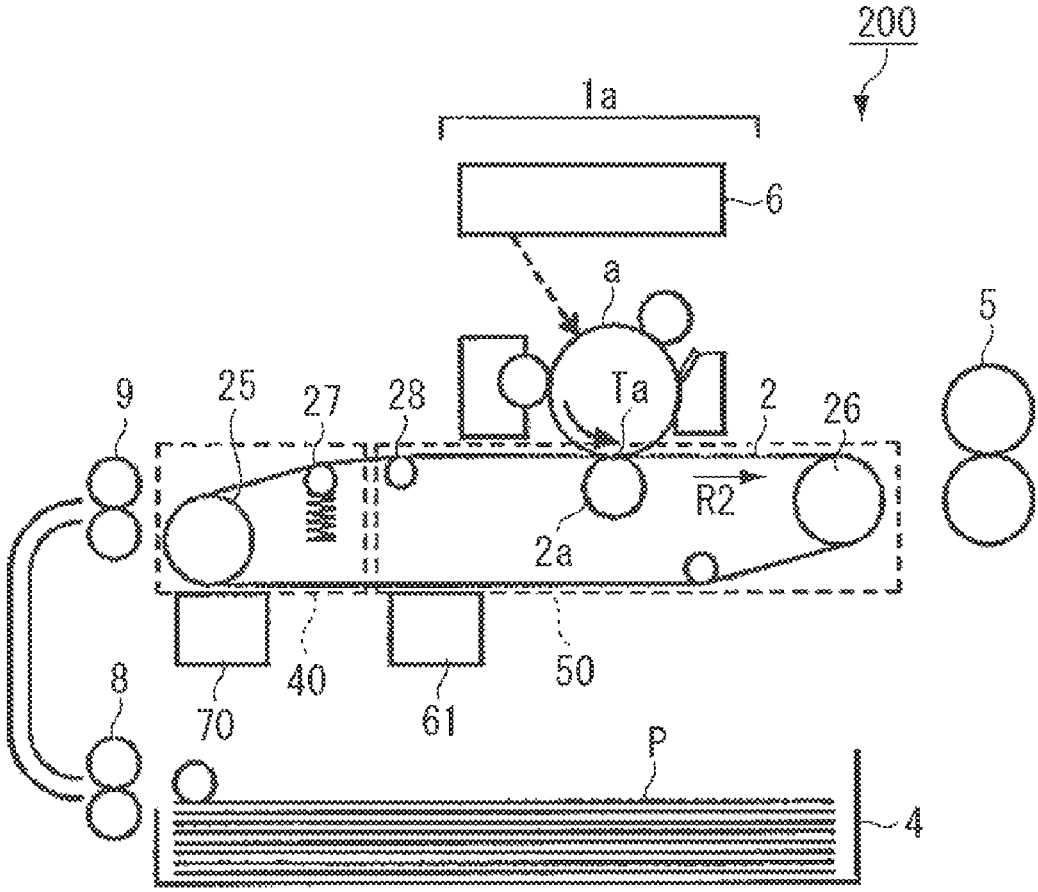
FIG. 9 is a view illustrating a configuration of an image forming apparatus according to a second exemplary embodiment of the present invention.

FIG. 9 is a view illustrating a configuration of an image forming apparatus according to a second exemplary embodiment of the present invention.

As illustrated in FIG. 9, an image forming apparatus 200 according to the second exemplary embodiment is a direct transfer type image forming apparatus in which a toner image is transferred from a photosensitive drum a to a recording material that is suctioned and carried by a recording material conveyance belt 2.

A transfer belt (2) is rotated in the state that the transfer belt 2 is in contact with the image bearing member (a). A stretching roller 25 suspends the recording material conveyance belt 2 at the one end side with the photosensitive drum a interposed therebetween. A driving roller 26, which functions also as a steering roller, drives the recording material conveyance belt 2 to be rotated at the opposite side of the stretching roller 25 with the photosensitive drum a interposed therebetween.

In the first frame 50, the two ends of the stretching roller 25 are rotatably supported, so that the two end sides thereof are connected to each other at the rear side of the recording material conveyance belt 2. The second frame 40 can be tilted relative to the first frame 40, and the two ends of the driving roller 26 are rotatably supported, so that the two end sides thereof are connected to each other at the rear side of the recording material conveyance belt 2. The steering driving unit 61 is disposed on the first frame 50 to move up and down the one side of the second frame 40. Therefore, the second frame 40 can be tilted, so that the recording material conveyance belt 2 can be steered by the driving roller 26.

A motor 70, which drives the driving roller 26, is disposed on the second frame 40 to transmit a driving force to the driving roller 26 on the second frame.

The tension roller 27 exerts a tension onto the recording material conveyance belt 2 by pressing the recording material conveyance belt 2 outwards between the driving roller 26 and the transfer stretching roller 28. The tension roller 27 is configured so that the two ends thereof are individually supported through springs by the second frame 40.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-067855 filed Mar. 19, 2009, which is hereby incorporated by reference herein in its entirety.

What is claimed is:

1. An image forming apparatus comprising:

a photosensitive member;

a rotatable intermediate transfer belt configured to carry a toner image transferred from the photosensitive member;

a supporting roller configured to support the intermediate transfer belt and to form a transfer portion at which the toner image formed on the intermediate transfer belt is transferred to a recording material;

a driving roller disposed in an upstream side of the photosensitive member and in a downstream side of the transfer portion in a rotational direction of the intermediate transfer belt and configured to transmit a driving force to the intermediate transfer belt;

a motor configured to supply a driving force to the driving roller;

a first frame configured to rotatably support two ends of the supporting roller;

a second frame disposed to be tiltable relative to the first frame and configured to rotatably support two ends of the driving roller;

a belt position sensor disposed on the second frame and configured to detect a position of the intermediate transfer belt in a longitudinal direction of the driving roller;

a tilt driving unit configured to tilt the second frame to the first frame so as to tilt the driving roller relative to the supporting roller;

a tension roller disposed on the second frame and at a position adjacent the driving roller in the downstream side of the driving roller in the rotational direction of the intermediate transfer belt and configured to supply a tension to the intermediate transfer belt;

an elastic unit configured to elastically support the tension roller; and a control unit configured to control the tilt driving unit based on the belt position detected by the belt position sensor.

2. The image forming apparatus according to claim 1, wherein the second frame is configured so that in a longitudinal direction of the driving roller one end side thereof is pivotally supported by the first frame and the other end side thereof is supported to be movable along an edge of the other end side of the first frame, and wherein the motor is mounted on the one end side of the second frame.

3. The image forming apparatus according to claim 2, wherein the tilt driving unit is disposed on the first frame, and wherein the first frame and the second frame constitute an intermediate transfer unit which can be integrally attached and detached from a main body of the image forming apparatus without releasing a driving mechanism of the main body of the image forming apparatus.

4. The image forming apparatus according to claim 1, further comprising a primary transfer roller configured to transfer a toner image from the photosensitive member to the intermediate transfer belt in a primary transfer portion and a belt positioning roller disposed between the tension roller and the primary transfer portion, and configured to position the intermediate transfer belt in the primary transfer portion.

5. The image forming apparatus according to claim 1, wherein two end portions of the tension roller are supported through the elastic unit by the second frame.

6. An image forming apparatus comprising:

a photosensitive member;

a rotatable media conveyance belt configured to carry recording media;

a supporting roller configured to support the media conveyance belt;

a driving roller disposed in an upstream side of the photosensitive member and in a downstream side of the supporting roller in a rotational direction of the media conveyance belt and configured to transmit a driving force to the media conveyance belt;

a motor configured to supply a driving force to the driving roller;

a first frame configured to rotatably support two ends of the supporting roller;

a second frame disposed to be tiltable relative to the first frame and configured to rotatably support two ends of the driving roller;

a belt position sensor disposed on the second frame and configured to detect a position of the media conveyance belt in a longitudinal direction of the driving roller;

a tilt driving unit configured to tilt the second frame to the first frame so as to tilt the driving roller relative to the supporting roller;

a tension roller disposed on the second frame and at a position adjacent the driving roller in the downstream side of the driving roller in the rotational direction of the media conveyance belt and configured to supply a tension to the media conveyance belt;

an elastic unit configured to elastically support the tension roller; and a control unit configured to control the tilt driving unit based on the belt position detected by the belt position sensor.

7. The image forming apparatus according to claim 6, wherein the second frame is configured so that in a longitudinal direction of the driving roller one end side thereof is pivotally supported by the first frame and the other end side thereof is supported to be movable along an edge of the other end side of the first frame, and wherein the motor is mounted on the one end side of the second frame.

8. The image forming apparatus according to claim 7, wherein the tilt driving unit is disposed on the first frame, and wherein the first frame and the second frame constitute a media conveyance unit which can be integrally attached and detached from a main body of the image forming apparatus without releasing a driving mechanism of the main body of the image forming apparatus.

9. The image forming apparatus according to claim 6, further comprising: a transfer roller configured to transfer a toner image from the photosensitive member to a recording material in a transfer portion; and a belt positioning roller disposed between the tension roller and the transfer portion and configured to position the media conveyance belt in the transfer portion.

10. The image forming apparatus according to claim 6, wherein two end portions of the tension roller are supported through the elastic unit by the second frame.

* * * * *